US006823945B2

(12) United States Patent
Eslinger et al.

(10) Patent No.: US 6,823,945 B2
(45) Date of Patent: Nov. 30, 2004

(54) PRESSURE COMPENSATING APPARATUS AND METHOD FOR DOWNHOLE TOOLS

(75) Inventors: David M. Eslinger, Broken Arrow, OK (US); Avel Z. Ortiz, Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 113 days.

(21) Appl. No.: 10/252,337

(22) Filed: Sep. 23, 2002

(65) Prior Publication Data

US 2004/0055761 A1 Mar. 25, 2004

(51) Int. Cl.[7] ..... E21B 33/12
(52) U.S. Cl. ..... 166/387; 166/383
(58) Field of Search ..... 166/387, 383, 166/120, 123

(56) References Cited

U.S. PATENT DOCUMENTS

| | | | | |
|---|---|---|---|---|
| 4,252,197 | A | 2/1981 | Pringle | |
| 4,501,441 | A | 2/1985 | Crews | |
| 4,610,300 | A | 9/1986 | Mullins, II et al. | |
| 4,660,646 | A | 4/1987 | Blizzard | |
| 4,665,977 | A | 5/1987 | Mullins | |
| 4,735,266 | A | 4/1988 | Stone et al. | |
| 4,791,991 | A | 12/1988 | Morris et al. | |
| 4,836,278 | A | 6/1989 | Stone et al. | |
| 4,862,961 | A | 9/1989 | Neff | |
| 5,058,673 | A * | 10/1991 | Muller et al. | 166/187 |
| 5,310,004 | A | 5/1994 | Leismer | |
| 5,311,939 | A | 5/1994 | Pringle et al. | |
| 5,361,836 | A | 11/1994 | Sorem et al. | |
| 5,507,341 | A | 4/1996 | Eslinger et al. | |
| 5,513,703 | A | 5/1996 | Mills et al. | |
| 6,131,663 | A | 10/2000 | Henley et al. | |
| 6,257,339 | B1 | 7/2001 | Haugen et al. | |
| 6,289,994 | B1 * | 9/2001 | Willauer | 166/387 |
| 6,425,443 | B1 | 7/2002 | Hill et al. | |
| 6,467,540 | B1 * | 10/2002 | Weinig et al. | 166/120 |
| 2004/0035589 | A1 * | 2/2004 | Kilgore et al. | 166/383 |

OTHER PUBLICATIONS

"Model 'D' Tension Packer", Petro–Tech Tools, 1999, 8 pages.

"Guiberson G–77 Packer", Halliburton, p. 2–20, no date.

"Guiberson G–77 Packer", A Hydraulic–Set Packer That Saves Rig Time, Halliburton, Jul. 1999, 2 pages.

"TRC–DH Series", Tubing–Retrievable Safety Valve, Schlumberger, pp 13–14, no date.

* cited by examiner

*Primary Examiner*—David Bagnell
*Assistant Examiner*—Daniel P Stephenson
(74) *Attorney, Agent, or Firm*—Wayne Kanak; Robin Nava; Brigitte L. Echols

(57) ABSTRACT

An apparatus and method for opposing pressure-induced forces acting on a mandrel of a downhole tool. The apparatus and method are particularly suited for use with a packer and include a piston engageable with the mandrel. Forces placed upon the piston by pressure communicated from the tubing bore are transferred to the mandrel.

30 Claims, 2 Drawing Sheets

PRESSURE COMPENSATING APPARATUS AND METHOD FOR DOWNHOLE TOOLS

BACKGROUND OF THE INVENTION

1. Field of the Invention

The invention relates to methods, apparatus and systems for opposing pressure-induced loads acting upon downhole equipment components. In one embodiment, for example, the invention relates to methods, apparatus and systems capable of at least partially offsetting pressure-induced forces acting upon the mandrel and resulting forces on the shear element of a downhole packer system.

2. Description of Related Art

In the petroleum exploration and recovery industries, equipment used in subsurface wells is often subject to various pressure-induced loads. For example, "packers" are commonly employed in subsurface wells for securing the position of tubing or other equipment in the well, and for zonal isolation to allow various treatments, or operations, to be conducted. A typical packer includes, among other components, a mandrel having a conduit in fluid communication with the tubing, one or more slips that anchor the packer to the wellbore or casing, one or more elastomeric elements that seal the wellbore at the packer, and one or more shear elements to enable emergency unset of the packer, or some combination thereof. The shear element is typically located on the mandrel and engages the mandrel with other packer components.

In use, the typical packer is set at the desired location in the wellbore. A tension-set type packer, for example, is set by applying tension to the tubing on which the packer is conveyed into the wellbore. Such tension is transferred through the mandrel and shear element, such as a shear ring, to the elastomeric element(s) and slip(s), energizing the elastomeric element and forcing the slip into contact with the wellbore wall. In any case, after the packer is set, treating pressure can be applied through the tubing to the isolated wellbore below the packer. The treating pressures cause loads to be placed upon the mandrel, referred to herein as "pressure-induced forces" ($F_1$). Examples of pressure-induced forces may include tubing forces arising from pressure ballooning of the tubing and friction of fluid pumped through the tubing. The pressure-induced forces are transferred from the mandrel through the shear element to the packer's elastomeric element and slip. Under such forces, the shear element is often forced upwardly into contact with other components of the packer system, imparting shearing loads, or resisting mechanical forces, upon the shear element.

As a result of pressure-induced forces placed upon downhole equipment in the petroleum exploration and recovery industries, limitations are placed upon downhole equipment and/or operations. For example, if the pressure-induced forces upon the shear element of a packer system exceed its shear rating, the shear element may fail. Thus, while the shear element must be designed to fail, or shear, under a certain tension to allow emergency unsetting of the packer, it must also be designed to withstand certain pressure-induced forces to avoid premature or undesirable failure during operations.

Shear elements are often designed with shear ratings sufficient to prevent shearing during normal operations, or to withstand high well treating pressures, but with an emergency unset load that may be greater than the tensile rating of the tubing. Consequently, the tubing or other equipment may fail or become damaged and/or the shear element may not shear as desired to unset the packer.

Further, in some operations, a "disconnect" may be used in conjunction with one or more downhole components, such as a bottom-hole assembly, to allow emergency disconnect of the tubing therefrom. When a packer system is also employed, the disconnect load for the disconnect must be greater than the packer shear element emergency unset load and less than the tubing tensile rating. Consequently, the inclusion of a disconnect further restricts the rating of the packer shear element and, ultimately, the allowable treating pressures during operations.

Thus, there remains a need for methods, apparatus, and/or systems capable of one or more of the following: opposing forces placed upon the shear element of a downhole component; opposing pressure-induced forces placed upon the mandrel of a packer system during use; opposing or balancing mechanical loads placed upon the shear element of a tension-set packer due to pressure-induced forces placed upon the mandrel of a packer system; compensating for upwardly acting, pressure-induced, forces on the mandrel of a packer caused by tubing pressure; opposing the tubing pressure load on a mandrel to reduce the resulting mechanical load on a shear ring of a tension-set packer system; and offsetting the generally upwardly acting mechanical loads on the shear element of a packer resulting from pressure-induced forces on the mandrel of the packer during use.

BRIEF SUMMARY OF THE INVENTION

In accordance with the present invention, certain embodiments involve an apparatus for opposing pressure-induced forces acting upon the mandrel of a packer during use of the packer in a borehole. The packer is in fluid communication with the bore of a tubing. The apparatus includes a piston housing having a cavity and a piston disposed and axially movable within the cavity. The piston is associated with a piston carrier and engageable with the mandrel of the packer. At least one port is disposed in the piston carrier above the piston and capable of allowing pressure communication between the tubing bore and the cavity above the piston, whereby forces placed upon the piston thereby are transferred to the mandrel and capable of at least partially opposing pressure-induced forces acting upon the mandrel.

Forces placed upon the piston and transferred to the mandrel may offset pressure-induced forces acting upon the mandrel. The piston, the piston carrier, and the cavity may be sized to offset the pressure-induced forces acting on the mandrel. Such forces acting on the mandrel are the result of fluid pressure acting on the mandrel cross-section, pressure ballooning or contraction of the tubing, and fluid friction acting on the tubing.

The piston may be located above the packer. At least one hole may be included in the piston housing and extend between the cavity below the piston and the borehole, the hole(s) allowing pressure communication between the borehole and the cavity below the piston.

The packer may be a tension-set packer, which may be deployed on coiled tubing. The packer may be capable of multi-set operation. The packer may include at least one shear element engaged with the mandrel, whereby forces transferred to the mandrel from the piston are applied to the shear element. The shear element(s) may be a shear ring.

In various embodiments, the present invention involves a pressure-compensating apparatus for opposing pressure-induced forces acting generally upwardly upon the mandrel of a tension-set packer during use of the tension-set packer within a borehole. The mandrel is associated with and axially movable relative to a packer housing. The tension-set packer is in fluid communication with the bore of a tubing. A piston is engageable with the mandrel, the piston being driven by pressure communicated from the tubing bore, whereby generally downwardly acting axial forces placed upon the piston from pressure communicated from the tubing bore may be transferred to the mandrel to at least partially oppose pressure-induced forces acting generally upwardly upon the mandrel.

The piston may be disposed and axially movable within a cavity, in which case the mandrel is axially movable relative to the packer housing coincident with the axial movement of the piston within the cavity. The piston may be carried by a piston carrier and at least one port may be disposed in the piston carrier and capable of allowing pressure communication between the tubing bore and the cavity above the piston. The piston and cavity may be disposed in a piston housing and at least one hole may be disposed in the piston housing to extend between the cavity and the borehole, the hole(s) allowing pressure communication between the borehole and the cavity below the piston.

The tension-set packer may be deployed on coiled tubing, and may be capable of multi-set operation. Forces placed upon the piston and transferred to the mandrel may be capable of balancing pressure-induced forces acting upon the mandrel. The piston may be located up-hole of the tension-set packer.

There are yet some embodiments of the invention that involve an apparatus for at least partially reducing mechanical forces acting upon at least one shear ring of a packer system during use of the packer system in a borehole. The shear ring is carried by a mandrel and the mechanical forces acting on the shear ring are caused by pressure-induced forces acting on the mandrel. The packer system is in fluid communication with the bore of a tubing. The apparatus includes a housing having a cavity, and a piston disposed and axially movable within the cavity. The piston is associated with a piston carrier and engageable with the mandrel of the packer system. At least one port is formed in the piston carrier above the piston, the at least one port capable of allowing fluid pressure communication between the tubing bore and the cavity above the piston. Generally downwardly acting forces placed upon the piston by pressure in the cavity are transferred to the mandrel and the at least one shear ring.

The packer system may include a tension-set packer deployed on coiled tubing, and the tension-set packer may be capable of multi-set operation. Generally downwardly acting forces placed upon the piston and transferred to the mandrel may be capable of equalizing pressure-induced forces acting upon the mandrel.

Various embodiments of the invention involve a pressure-balanced, tension-set packer system in fluid communication with the bore of a tubing. The system includes a packer housing, a mandrel associated with and axially movable relative to the packer housing and a piston engageable with the mandrel and carried by a piston carrier. The piston is disposed and axially movable within a cavity. At least one port formed in the piston carrier is capable of allowing pressure communication between the tubing bore and the cavity above the piston, whereby forces placed upon the piston may be transferred to the mandrel, at least partially opposing pressure-induced forces acting upon the mandrel. Forces placed upon the piston and transferred to the mandrel may be capable of balancing pressure-induced forces acting upon the mandrel. The tension-set packer may be capable of multi-set operations and deployed on coiled tubing.

There are yet many embodiments of the invention that involve a method for opposing generally upwardly acting, pressure-induced forces upon the mandrel of a tension-set packer during use of the packer in a borehole. The tension-set packer is in fluid communication with the bore of a tubing. This method includes connecting a piston with the mandrel, deploying the tension-set packer into the borehole, and setting the tension-set packer in the borehole. Generally upwardly acting, pressure-induced forces are allowed to act upon the mandrel, and pressure from the tubing bore is ported to the up-hole side of the piston. Generally downwardly acting forces applied to the piston are transferred to the mandrel, thereby opposing generally upwardly acting, pressure-induced forces upon the mandrel.

Such method may further include disposing the piston within a cavity, associating the piston with a piston carrier and forming a port in the piston carrier to allow the communication of pressure to the cavity above the piston from the tubing bore. If desired, the method may include designing the piston, piston carrier, and cavity so that forces transmitted to the mandrel from the piston will offset generally upwardly acting, pressure-induced forces upon the mandrel. The method may include enabling multi-set operations of the tension-set packer. If desired, the method may be conducted in a non-vertically oriented borehole.

Accordingly, the present invention includes features and advantages that are believed to enable it to advance the technology associated with compensating for pressure-induced forces on downhole equipment. Characteristics and advantages of the present invention described above, as well as additional features and benefits, will be readily apparent to those skilled in the art upon consideration of the following detailed description of preferred embodiments and referring to the accompanying drawings.

BRIEF DESCRIPTION OF THE DRAWINGS

For a detailed description of preferred embodiments of the invention, reference will now be made to the accompanying drawings wherein.

DETAILED DESCRIPTION OF THE INVENTION

Figure 1:
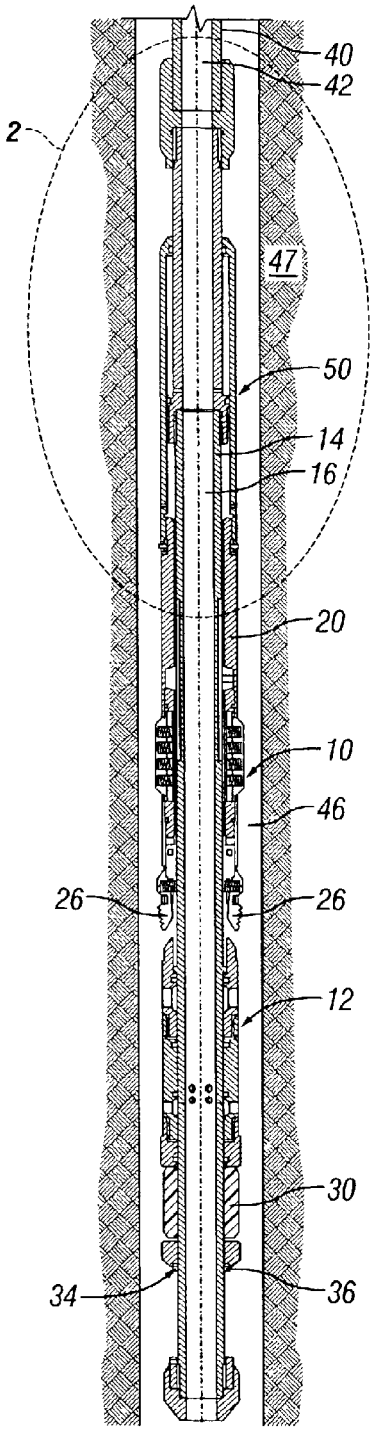
FIG. 1 is a generally schematic view of a packer system in a neutral, unset position in a borehole, the packer system shown associated with an embodiment of a pressure compensating apparatus in accordance with the invention.

Presently preferred embodiments of the invention are shown in the above-identified figures and described in detail below. It should be understood that the appended drawings and description herein of specific embodiments is not intended to limit the invention to the particular forms disclosed. On the contrary, the intention is to cover all modifications, equivalents, and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout the various portions of this patent, the terms "invention", "present invention", and variations thereof are not intended to mean the claimed invention of any particular of the appended claim or claims, or all of the appended claims. These terms are used to merely provide a reference point for subject matter discussed in this specification. The subject or topic of each such reference is thus not necessarily part of, or required by, any particular claim(s) merely because of such reference. Accordingly, the use herein of the terms "invention", "present invention", and variations thereof is not intended and should not be used to limit the construction or scope of the appended claims.

Referring initially to FIG. 1, a packer system 10 is shown associated with a pressure compensating apparatus 50 of the present invention. The illustrated packer system 10 is a multi-set, tension-set packer 12, but can be any other type of packer system, such as a pressure-set packer system. The present invention is thus not limited to use with multi-set, tension-set type packers, and the form or operation of the packer system is not limiting upon the present invention.

The exemplary packer system 10 is shown disposed within a borehole 46 in the earth 47 in a neutral or unset position. As used herein and throughout the various parts of this patent, the terms "borehole", "wellbore", "well" and variations thereof means any hole, passageway or area suitable for use with the present invention. While the borehole 46 of FIG. 1 appears vertically-oriented, the present invention is not limited to any particular orientation of the borehole 46. For example, the packer system 10 may be used in a borehole 46 that is non-vertical, such as a "horizontal" or "deviated" well. The present invention is thus not limited in any way by the type or orientation of borehole within which it is, or may be, used.

Still referring to FIG. 1, the packer 12 is shown including a mandrel 14, packer housing 20, one or more slips 26, an elastomeric element 30, and a shear element 34, as are or become known. The shear element 34 is shown as a shear ring 36, but can take any suitable form as is or becomes known. The illustrated mandrel 14 includes a conduit 16 in fluid communication with the axial bore 42 of a tubing 40 used to convey the packer system 10 into the borehole 46. These components of the packer 12, if included, may take any suitable form, and the packer 12 may include other or different elements. The tubing 40 may be any suitable tubing or other components. Thus, as used herein and throughout the various portions of this patent, the term "tubing" and variations thereof means coiled tubing, jointed drill-string elements, tubing connectors or any other suitable component (s). The present invention is thus not limited in any way by the type, configuration and form of items with which the packer system 10 is, or may be, connected or used.

The above brief description of the packer system 10 is provided for illustrative purposes only and is not limiting upon the present invention. The type, operation, components and arrangement of the packer system 10 are in no way limiting upon the present invention. Further details of the components, arrangement and operation of the packer system 10, or packer 12, as well as alternate components and arrangements therefore are, or will be, known to persons skilled in the art and can be found in various patents and printed publications, such as, for example, U.S. Pat. Nos. 6,257,339; 4,862,961; and 4,665,977, each of which is incorporated by reference herein in its entirety. The pressure compensating apparatus 50 of the present invention may be thus used with any suitable equipment and in any suitable environment.

Figure 2:
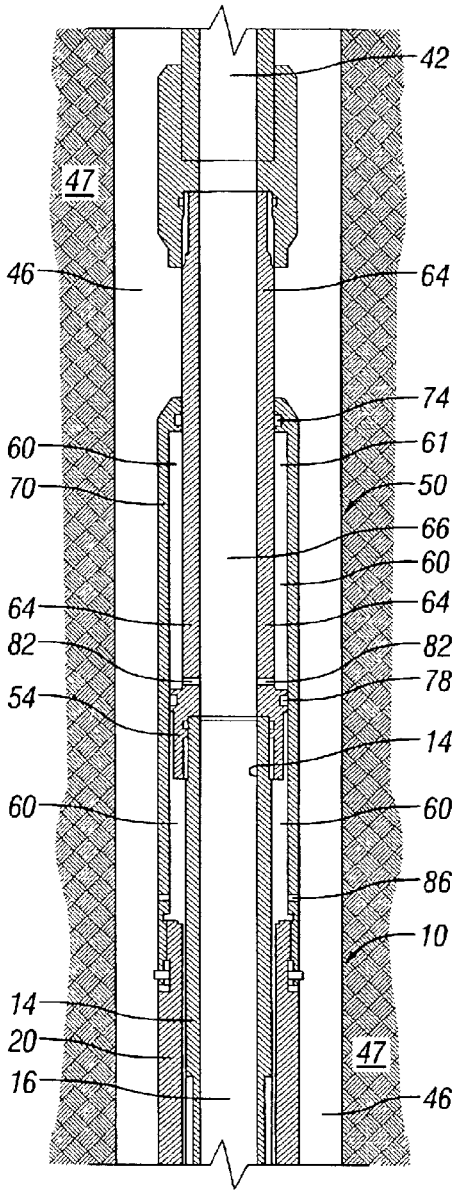
FIG. 2 is a partial cross-sectional view of an embodiment of a pressure compensating apparatus in accordance with the present invention shown used with a packer system in a set position in a borehole.

Now referring to the embodiment of FIG. 2, the pressure compensating apparatus 50 of the present invention includes a piston 54 disposed and movable within a cavity 60. The piston 54 connects to the mandrel 14 of the packer system 10 and is capable of causing the mandrel 14 to move axially relative to the packer housing 20 coincident with axial movement of the piston 54 in the cavity 60. In this manner, in accordance with the invention, by placing forces upon the piston 54, forces may be placed upon the mandrel 14, and ultimately the shear element 34.

Still referring to the exemplary embodiment of FIG. 2, the piston 54 is shown disposed above, or upstream of, the packer system 10 and is threadably engaged with the mandrel 14. However, the present invention is not limited to such position of the piston 54 or its manner of connection to the mandrel 14. The illustrated piston 54 has a tubular shape, and the cavity 60 has an annular shape. However, the piston 54 and cavity 60 can have any desired configuration and take any desired shape. Furthermore, the invention may include numerous pistons 54 and/or cavities 60, as is desired.

One or more seals 74, such as a rod seal, may be included to provide a seal proximate to the upper end 61 of the cavity 60, and one or more seals 78 may be disposed around the piston 54 to seal the cavity 60 proximate to the location of the piston 54. Seals 74, 78 are shown as O-ring seals, but may be any suitable sealing component(s).

The illustrated piston 54 is shown carried by a carrier 64, which is connected at its upper end to the tubing 40. The carrier 64 has a central passageway 66 in fluid communication with the axial bore (not shown) of the tubing 40 and the conduit 16 of the mandrel 14. The piston 54 may be integral to, or connected with, the carrier 64 in any suitable manner as is desired. For example, the carrier 64 may be a piston rod. A piston housing 70 is shown enclosing the piston 54, carrier 64, and cavity 60. In this embodiment, the piston housing 70 is threadably connected to the upper end of the packer housing 20, but any suitable configuration and form of connection may be used.

The pressure compensating apparatus 50 is designed to place forces upon the piston 54 by pressurizing the cavity 60. In the embodiment of FIG. 2, for example, generally downward forces may be placed upon the piston 54 relative to the piston housing 70, forcing the mandrel 14 downwardly relative to the packer housing 20. One purpose for such action, for example, is to oppose pressure-induced forces acting generally upwardly upon the mandrel 14 and the resulting mechanical forces on the shear element 34 during use of the packer system 10.

In the example of FIG. 2, one or more ports 82 extend through the wall of the piston carrier 64 up-hole of, or above, the piston 54. The ports 82 allow the communication of pressure to the cavity 60 from the flow passage that includes the central passageway 66 of the carrier 64, the conduit 16 of the mandrel 14, and the axial bore (not shown) of the tubing 40. Thus, in this embodiment, the piston 54 may be loaded through the port(s) 82 on its up-hole side by tubing pressure existing at, or below, the packer system 10.

The illustrated embodiment also includes one or more holes 86 extending through the wall of the piston housing 70 and communicating pressure between the borehole 46 above the packer 12 and the cavity 60 below or downhole of the piston 54. Wellbore pressure is thus ported to the underside of the piston 54, so as to create a reference pressure in the cavity 60 or to account for differential pressures.

Figure 3:
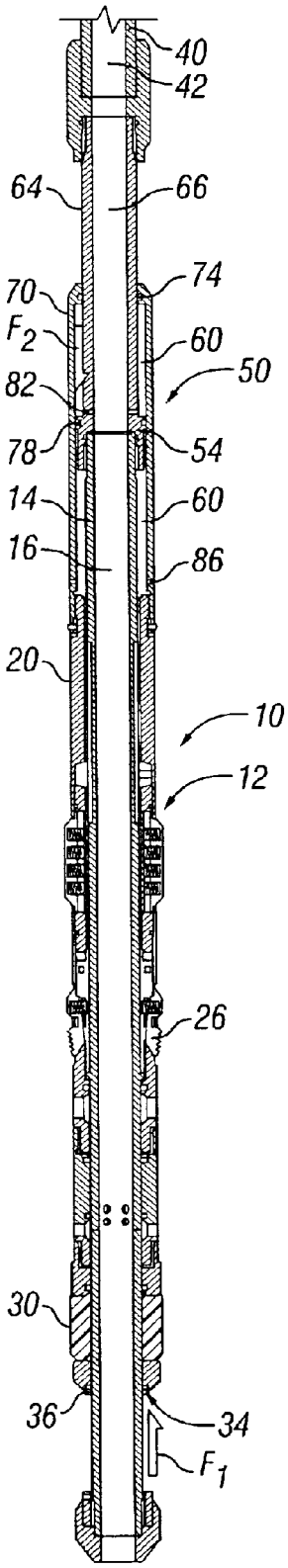
FIG. 3 is a generally schematic view of the pressure compensating apparatus and packer system of FIG. 2 with the packer in its set position.
Figure 4:
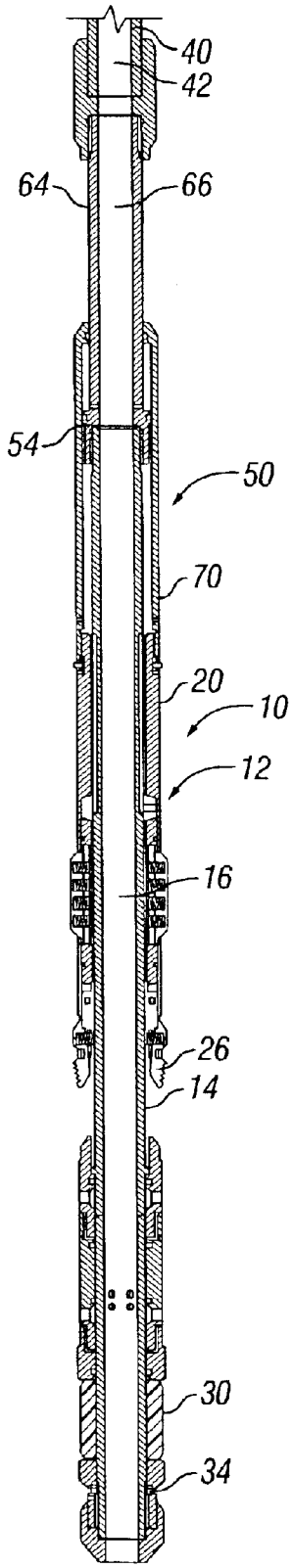
FIG. 4 is a generally schematic view of the pressure compensating apparatus and packer system of FIG. 3, the packer system shown in an emergency release position with the shear element sheared.

In FIG. 3, the packer 12 is shown in its set position, as indicated by the elastomeric element 30 being in a "squeezed-out" position. FIG. 4 shows the packer 12 in an emergency release position, the shear element 34 being sheared. However, the differing positions of the packer system 10, such as shown in FIGS. 1–4 are in no way limiting upon the present invention.

Referring to FIG. 3, if desired, the pressure compensating apparatus 50 may be designed to provide forces ($F_2$) upon the mandrel 14 that precisely, or approximately, offset or compensate for pressure-induced forces ($F_1$) acting upon the mandrel 14. To accomplish this, the effective piston area (Ap) may be sized to provide force(s) $F_2$ that are approximately, substantially or precisely, equal to and opposite the force(s) $F_1$.

In the embodiment shown, for example, the pressure compensating apparatus 50 is designed with an effective piston area (Ap) that is equal to the effective mandrel area (Am) acted upon by the tubing pressure. In the equation ($F_1=P_1\times Am$), $F_1$ represents the pressure-induced forces on the mandrel 14; $P_1$ represents the tubing pressure acting upon the mandrel 14; and Am is the effective surface area of the mandrel 14 upon which $P_1$ acts. (It should be noted that Am includes the effects of ballooning of the tubing and fluid friction). In the equation ($F_2=P_2\times Ap$), $F_2$ presents the forces acting on the piston 54 that are transferred to the mandrel 14; $P_2$ is the tubing pressure acting on the piston 54; and Ap is the effective surface area of the piston 54 (and piston carrier 64) upon which $P_2$ acts. Since $P_1=P_2$ in this embodiment, $F_2$ will equal $F_1$ if Ap is designed to equal to Am.

An example comparison of loads placed upon the respective shear elements of a first packer system not equipped according to the present invention and a second packer system used with an embodiment of the present invention is provided below. In this example, which is in no way limiting upon the present invention, the following conditions are presumed:

| | | |
|---|---|---|
| Coiled tubing outer diameter (CT OD): | 2.38 | inches (60.5 mm) |
| Coiled tubing inner diameter (CT ID): | 2.00 | inches (50.8 mm) |
| Packer mandrel outer diameter: | 2.375 | inches (60.3 mm) |
| True vertical (TV) depth: | 10,000 | feet (3,048 m) |
| Coiled tubing load at 80% yield: | 93,000 | pounds (42,185 kg) |
| Packer setting load: | 6,000 | pounds (2,722 kg) |
| Coiled tubing and annulus pressure before treatment: | 4,300 | pounds/square inch (302 kg/square cm) |
| Circulation pressure during treatment: | 10,000 | pounds/square inch (703 kg/square cm) |
| Bottomhole coiled tubing pressure during treatment: | 13,500 | pounds/square inch (949 kg/square cm) |
| Bottomhole annulus pressure during treatment: | 4,300 | pounds/square inch (302 kg/square cm) |
| Shear ring and disconnect tolerance: | +/−10 | percent |
| Coiled tubing hanging weight: | ~40,000 | pounds (18,144 kg) |

In the example of the tension-set packer not including the present invention, the operating load on the shear ring during treatment is estimated at 32,000 pounds (14,515 kg). The effective mandrel area Am is 32,000 pounds/(13,500–4,300 pounds/square inch)=3.48 square inches (22.4 square cm). With a minimum 5,000 pound (2,268 kg) margin between operating load and minimum ring shear, the nominal shear rating is 41,000 pounds (18,598 kg) for 10 percent tolerance, and the maximum shear rating is 45,000 pounds (20,412 kg). With such minimum of 5,000 pounds (2,268 kg) separation between maximum ring shear and minimum disconnect load, the minimum nominal load is 55,000 pounds (24,948 kg) for 10 percent tolerance and the maximum disconnect load is 61,000 pounds (27,670 kg). The surface weight to disconnect is 101,000 pounds (45,814 kg) for a hanging weight of 40,000 pounds (18,144 kg), which is 8,000 pounds (3,629 kg) over the conventional maximum allowable coiled tubing load.

In contrast, in use of the tension-set packer with an embodiment of the pressure compensating apparatus of the present invention having a piston area (Ap) of 3.0 square inches (19.4 square cm), the load on the shear ring during treatment is 5,000 pounds (2,268 kg), that is, (32,000 pounds−((differential pressure, coiled tubing to bottom hole annulus)×Ap)=32,000 pounds−((13,500−4,300) pounds/square inch×3.0 square inches). For the same margins and tolerances as provided above, the maximum required shear rating is 12,000 pounds (5,443 kg). The maximum disconnect load is 20,000 pounds (9,072 kg) and the maximum surface weight to disconnect is 60,000 pounds (27,216 kg). As compared to the above example, the coiled tubing load shear of this example is reduced by approximately 40,000 pounds (18,144 kg). It should be noted that all of the numerical values above are approximations.

The present invention includes additional features, capabilities, functions, methods, uses and applications that have not been specifically addressed herein but are, or will become, apparent from the description herein, the appended drawings and claims. Preferred embodiments of the present invention thus offer advantages over the prior art and are well adapted to carry out one or more of the objects of the invention.

It should be understood that the present invention does not require each of the techniques or acts described above. Moreover, the present invention is in no way limited to the above methods of opposing pressure-induced forces upon downhole components. Further, the methods described above and any other methods that may fall within the scope of any of the appended claims can be performed in any desired, suitable particular order and are not necessarily limited to the order described herein or listed in the appended claims. Yet further, the methods of the present invention do not require use of the particular embodiments shown and described in the present specification, such as, for example, the pressure compensating apparatus 50 of FIG. 1, but are equally applicable with any other suitable structure, form and configuration of components.

Also, it should be understood that the present invention does not require all of the above features and aspects. Any one or more of the above features or aspects may be employed in any suitable configuration without inclusion of other such features or aspects. Further, while preferred embodiments of this invention have been shown and described, many variations, modifications and/or changes of the apparatus and methods of the present invention, such as in the components, details of construction and operation, arrangement of parts and/or methods of use, are possible, contemplated by the applicants, within the scope of the appended claims, and may be made and used by one of ordinary skill in the art without departing from the spirit or teachings of the invention and scope of the appended claims. All matter herein set forth or shown in the accompanying drawings should thus be interpreted as illustrative and not limiting. Accordingly, the scope of the invention and the appended claims is not limited to the embodiments described and shown herein.

What is claimed is:

1. An apparatus for opposing forces acting on a mandrel of a downhole tool, the downhole tool deployed in a wellbore on a tubing having a bore therein, the apparatus comprising:

a piston housing having a cavity therein;

a piston disposed and axially movable within said cavity, said piston associated with a piston carrier, said piston carrier having a passage therein in fluid communication with the tubing bore;

said piston engageable with the mandrel so that forces acting on said piston may be transferred to the mandrel; and at least port disposed in said piston carrier, said at least one port allowing fluid communication between the tubing bore and said cavity;

wherein the downhole tool is a packer having at least one shear element carried on the mandrel, whereby forces transferred from said piston to the mandrel are applied to the shear element.

2. An apparatus for opposing pressure-induced forces acting upon a mandrel of a tension-set packer during use of the packer in a borehole, the packer being in fluid communication with the bore of a tubing, the apparatus comprising:

a piston housing, said piston housing having a cavity therein;

a piston disposed and axially movable within said cavity, said piston being associated with a piston carrier, said piston carrier having a fluid passage therein in fluid communication with the tubing bore;

said piston being engageable with the mandrel of the packer so that forces acting on said piston may be transferred to the mandrel; and at least one port disposed in said piston carrier above said piston, said at least one port allowing fluid communication between the tubing bore and said cavity above said piston.

3. The apparatus of claim 2, wherein the forces acting on said piston and transferred to the mandrel are capable of at least partially offsetting pressure-induced forces acting on the mandrel.

4. The apparatus of claim 3, wherein at least one among said piston, said piston carrier, and said cavity are sized to offset pressure-induced forces place upon the mandrel.

5. The apparatus of claim 2, wherein the tension-set packer is deployed on coiled tubing.

6. The apparatus of claim 5, wherein the tension-set packer is capable of multi-set operation.

7. An apparatus for opposing pressure-induced forces acting upon a mandrel of a tension set packer during use of the tension set packer in a borehole, the tension set packer being in fluid communication with the bore of a tubing, the apparatus comprising:

a piston housing, said piston housing having a cavity therein;

a piston disposed and axially movable within said cavity, said piston being associated with a piston carrier, said piston carrier having a fluid passage therein in fluid communication with the tubing bore;

said piston being engageable with the mandrel of the packer so that forces acting on said piston may be transferred to the mandrel; and at least one port disposed in said piston carrier above said piston, said at least one port allowing fluid communication between the tubing bore and said cavity above said piston, wherein said piston is located up-hole of the packer.

8. The apparatus of claim 7, further including at least one hole disposed in said piston housing and extending between said cavity below said piston and the borehole, said at least one hole allowing fluid communication between the borehole and said cavity below said piston.

9. The apparatus of claim 8, wherein the packer includes at least one shear element carried on the mandrel, whereby forces transferred from said piston to the mandrel are applied to the shear element.

10. The apparatus of claim 9, wherein said at least one shear element is a shear ring.

11. A pressure-compensating apparatus for opposing pressure-induced forces acting generally upwardly on a mandrel of a tension-set packer during use of the tension-set packer within a borehole, the mandrel being associated with and axially movable relative to a packer housing, the tension-set packer being in fluid communication with the bore of a tubing, the pressure-compensating apparatus comprising:

a piston engageable with the mandrel;

said piston being driven by fluid pressure communicated from the tubing bore, whereby generally downwardly acting axial forces acting on said piston from pressure communicated from the tubing bore may be transferred to the mandrel to at least partially oppose pressure-induced forces acting generally upwardly on the mandrel.

12. The pressure-compensating apparatus of claim 11, wherein said piston is disposed and axially movable within a cavity, whereby the mandrel is axially movable relative to the packer housing coincident with the axial movement of said piston within said cavity.

13. The pressure-compensating apparatus of claim 12, wherein said piston is carried by a piston carrier, further including at least one port disposed in said piston carrier above said piston and capable of allowing fluid pressure communication between the tubing bore and said cavity above said piston.

14. The pressure-compensating apparatus of claim 13, wherein said piston and said cavity are disposed in a piston housing, further including at least one hole disposed in said piston housing and extending between said cavity below said piston and the borehole, said at least one hole allowing fluid pressure communication between the borehole and said cavity below said piston.

15. The pressure-compensating apparatus of claim 11, wherein the tension-set packer is deployed on coiled tubing.

16. The pressure-compensating apparatus of claim 15, wherein the tension-set packer is capable of multi-set operation.

17. The pressure-compensating apparatus of claim 11, wherein forces acting on said piston and transferred to the mandrel are capable of balancing pressure-induced forces acting on the mandrel.

18. The pressure-compensating apparatus of claim 17, wherein said piston is located up-hole of the tension-set packer.

19. An apparatus for at least partially reducing mechanical forces acting on at least one shear ring of a packer system during use of the packer system in a borehole, the at least one shear ring being carried by a mandrel, the mechanical forces acting on the at least one shear ring caused by pressure-induced forces acting on the mandrel, the packer system being in fluid communication with the bore of a tubing, the apparatus comprising:

a housing having a cavity;

a piston disposed and axially movable within said cavity, said piston being associated with a piston carrier and engageable with the mandrel of the packer system; and at least one port formed in said piston carrier above said piston, said at least one port allowing fluid pressure communication between the tubing bore and said cavity above said piston, whereby generally downwardly acting forces placed upon said piston by pressure in said cavity are transferred to the mandrel and the at least one shear ring.

20. The apparatus of claim 19, wherein the packer system includes a tension-set packer deployed on coiled tubing.

21. The apparatus of claim 20, wherein the tension-set packer is capable of multi-set operation.

22. The apparatus of claim 20, wherein generally downwardly acting forces placed upon said piston and transferred to the mandrel are capable of equalizing pressure-induced forces acting upon the mandrel.

23. A pressure-balanced, tension-set packer system in fluid communication with the bore of a tubing, the system comprising:

a packer housing;

a mandrel associated with and axially moveable relative to said packer housing;

a piston engageable with said mandrel and carried by a piston carrier, said piston disposed and axially movable within a cavity;

at least one port formed in said piston carrier above said piston, said least one port allowing fluid communication between the tubing bore and said cavity above said piston, whereby forces acting on said piston may be transferred to said mandrel and are capable of at least partially opposing pressure-induced forces acting on the mandrel.

24. The system of claim 23, wherein forces acting on said piston and transferred to said mandrel are capable of balancing pressure-induced forces acting on said mandrel.

25. The system of claim 24, wherein the tension-set packer is capable of multi-set operation and is deployed on coiled tubing.

26. A method for opposing generally upwardly acting pressure-induced forces on a mandrel of a tension-set packer during use of the packer in a borehole, the tension-set packer being in fluid communication with the bore of a tubing, the method comprising:

connecting a piston with the mandrel;

deploying the tension-set packer into the borehole;

setting the tension-set packer in the borehole;

allowing generally upwardly acting, pressure-induced forces to act on the mandrel; and porting pressure from the tubing bore to the up-hole side of the piston whereby generally downwardly acting forces applied to the piston are transferred to the mandrel, thereby opposing the generally upwardly acting, pressure-induced forces acting on the mandrel.

27. The method of claim 26, further including disposing the piston within a cavity;

associating the piston with a piston carrier; and forming a port in the piston carrier to allow the communication of pressure to the cavity above the piston from the tubing bore.

28. The method of claim 27, further including designing the piston, piston carrier and cavity so that forces transmitted to the mandrel from the piston will offset generally upwardly acting, pressure-induced forces acting on the mandrel.

29. The method of claim 27, further including enabling multi-set operations of the tension-set packer.

30. The method of claim 29, wherein the borehole is non-vertically oriented.

* * * * *